US012453372B1

(12) United States Patent
DeMartini

(10) Patent No.: US 12,453,372 B1
(45) Date of Patent: Oct. 28, 2025

(54) CANNABINOID BLEND AND VAPE DEVICE AND METHOD

(71) Applicant: Richard James DeMartini, Libertyville, IL (US)

(72) Inventor: Richard James DeMartini, Libertyville, IL (US)

( * ) Notice: Subject to any disclaimer, the term of this patent is extended or adjusted under 35 U.S.C. 154(b) by 391 days.

(21) Appl. No.: 17/735,247

(22) Filed: May 3, 2022

Related U.S. Application Data

(60) Provisional application No. 63/183,252, filed on May 3, 2021.

(51) Int. Cl.
*A24F 40/30* (2020.01)
*A24F 40/48* (2020.01)

(52) U.S. Cl.
CPC ..... *A24F 40/30* (2020.01); *A24F 40/48* (2020.01)

(58) Field of Classification Search
None
See application file for complete search history.

(56) References Cited

U.S. PATENT DOCUMENTS

2010/0263681 A1* 10/2010 Zhao ..... A24F 1/30 131/173
2014/0202472 A1* 7/2014 Levitz ..... H01M 10/0525 131/187
2015/0366250 A1* 12/2015 Landau ..... A23L 2/56 426/2
2016/0206001 A1* 7/2016 Eng ..... A24F 40/30
2020/0107575 A1* 4/2020 Rene ..... A24D 1/14
2021/0127455 A1* 4/2021 Sur ..... A61M 11/042
2021/0251285 A1* 8/2021 Pasternack ..... A24F 40/30
2022/0079229 A1* 3/2022 Nicolas ..... A61M 15/0028

FOREIGN PATENT DOCUMENTS

WO WO-2020097737 A1 * 5/2020 ..... A24B 15/301

* cited by examiner

*Primary Examiner* — Philip Y Louie
*Assistant Examiner* — Nicole A Szumigalski
(74) *Attorney, Agent, or Firm* — Charles T. Riggs, Jr.

(57) ABSTRACT

A two-stage, real-time, six-cartridge cannabinoid blend and vape device enables a user to create and save custom blend settings of cannabinoid oils (THC, CBD, CBG, CBN terpenes, etc.) that then can be recalled and vaped using that exact blend information. The device distributes programmed heat instructions to each of the six cartridges allowing each cartridge to be heated simultaneously at different temperatures. When a user draws air in through the removable mouthpiece, the mouthpiece base collects the specific programmed vapor mixture and gives the user a custom blend of the six cartridges.

21 Claims, 8 Drawing Sheets

Fig. 2A
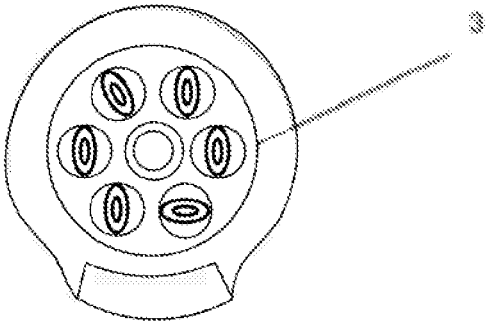
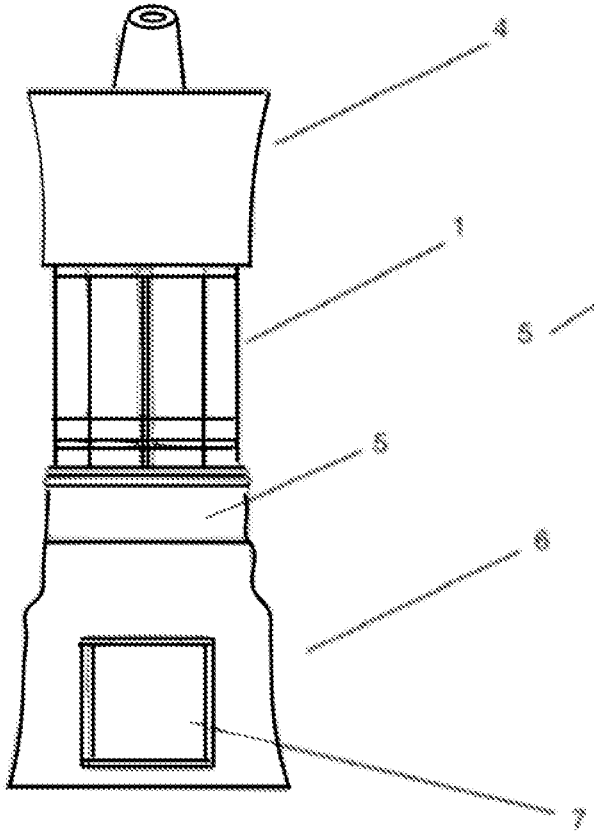
Fig. 2B
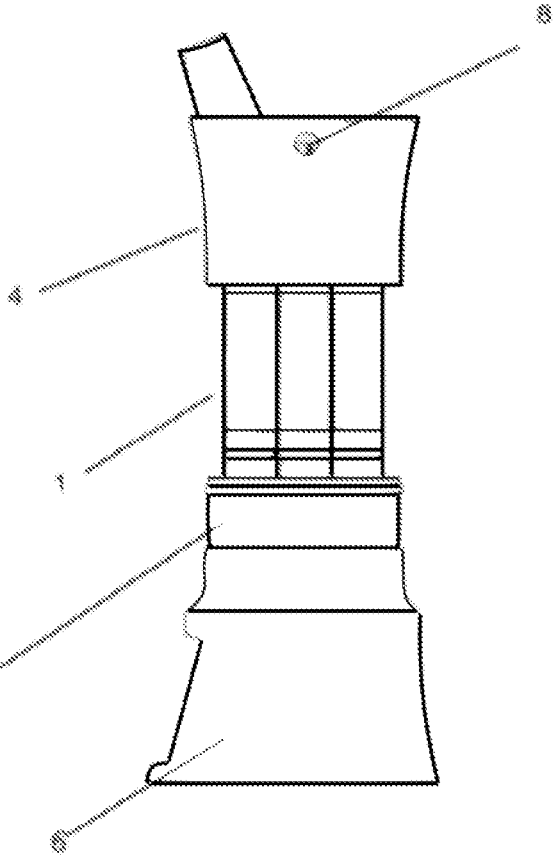
Fig. 2C

CANNABINOID BLEND AND VAPE DEVICE AND METHOD

FIELD

The present disclosure relates to a personal, portable, real-time, six-cartridge cannabinoid blend and vape device and replaceable cartridge set. It should be understood however that the bending and vape device, system and method disclosed herein could have any amount of cartridges which would be suitable for their intended purpose(s).

BACKGROUND

Standard vape pens and pen cartridges containing cannabinoids like THC, CBD, CBG, CBN, terpenes, etc. are sold in dispensaries in states where medical and/or recreational *cannabis* is legal. Cartridges containing cannabinoids that are not THC are sold online and in retail shops across the country. A customer can only purchase sealed, pre-packaged cartridge(s) due to current restrictions; while this makes for a safer product overall, it inhibits the user from customizing their cannabinoid blends to meet their needs. Consumers utilize different cannabinoid oils for specific effects they have on the body and mind. Being limited to pre-packaged products is a problem for consumers who want a certain combination of cannabinoid oils and flavoring as they vape.

The real-time blending and vaping device, along with a Smart Cartridge set, solves this problem by allowing users to purchase various cannabinoid and non-*cannabis* oil cartridges from a local dispensary (or wherever cartridges can be sold legally).

It is desired that the presently disclosed product and method be applicable generally to any instances or applications involving the use of liquid cannabinoids and the blending and dispensing thereof.

SUMMARY

The present disclosure relates to a personal, portable, real-time, six-cartridge cannabinoid blend and vape device, system and method, and replaceable cartridge set therefor.

The device preferably holds six standard pen cartridges and independently heats each cartridge element to a custom or preset temperature, thus allowing the user to inhale any combination of vapor produced by the six cartridges and their independent vapor outputs at the same time. Utilizing proprietary mixing software, a user can create, save and use a cannabinoid formula as a preset output blend for a custom experience.

Similar to single cartridge vape pens, cartridges are replaced when consumed. The user can choose which cannabinoid oil cartridges to load in the six cartridge slots, thus creating a personalized vaping experience.

The present disclosure is comprised of a handheld real-time, six-cartridge cannabinoid blend and vape device. The device is handheld and battery operated. It can either be manually controlled from the navigation buttons on the device or from the preset formula blends stored within the device memory on the CPU version.

For the CPU version, formula instructions will be downloaded via a mobile device or personal computer. The external controlling computer, phone or tablet will be connected to the device via wireless communication (e.g., Bluetooth or Wifi), or wired connections (e.g. USB). Device drivers interpret the proprietary formula mixing instruction set and will be available via download from the cloud and installed on a controller CPU in the device. The external controlling computer, phone or tablet will run proprietary, cloud-based software and will design real-time blending and vaping instructions for the CPU-enabled device preferably via Bluetooth or Wifi.

The device preferably holds six interchangeable standard or smart oil cartridges, each with a capacity range of a half gram to a full gram. More or less cartridges are contemplated. The device can also be loaded with standard off-the-shelf cartridges, available online or in dispensaries, when used in manual mode or with the manual version of the device and controlled manually by front panel buttons.

The Smart Cartridge technology set is a set, preferably six, of different pure-flavored cannabinoid cartridges that complement each other when combined, producing custom effects to the body and mind. Smart Cartridges automatically upload various attributes via QRCode when loaded, including but not limited to content type, flavor, strain, analytics, purity and potency to the controlling software. Smart cartridges come with a QRCode that contains specific information about their contents. The QR Code affixed to the cartridge in a suitable manner, such as printed or labeled, and is designed to be scanned into the mixing software and downloaded into the device via WIFI or Bluetooth. This will inform the device what is loaded in each slot and in some cases sample formulas using them.

Smart Cartridge technology is not only a key source of data acquisition, it also simplifies the cartridge loading process by automatically reading into the system the necessary attributes to create menus and custom blending tool instructions that are unique to that device's content, based on the information supplied in the QRCode and downloaded into the device via the mixing software. The user launches the proprietary mixing software, sets the desirable output cannabinoid vapor blend, and then transmits instructions to the device, preferably wirelessly.

Based on downloaded preset formula instructions or instructions set manually, the device blends the vapors of two or more different cannabinoid cartridges at various preset temperatures simultaneously, producing a custom vapor with a unique taste and effect. The hotter the heating element in the cartridge, the thicker or more intense the vapor is. This allows the device to combine the mixing of the separate vapor outputs, with each cartridge individually preset at their optimum heat, together creating a one-of-a-kind, real-time cannabinoid vaping experience.

The two-stage mixing process can offer hundreds of cannabinoid combinations from a single device. The device will have two modes: CPU mode, which supports Smart Cartridge technology, or a simple manual button navigation, allowing the user to set each cartridge element at a specific desired temperature from the front panel. The mouthpiece has an internal air-driven circulation fan that is responsible for distributing the vapor of the six outputs equally to the user when vaping.

The user can choose to save that formula online to the proprietary, cloud-based software or recall the preset to recreate the exact experience multiple times with the same expected results.

BRIEF DESCRIPTION OF DRAWINGS

A clear understanding of the features of the present disclosure summarized above may be had by reference to the appended drawings, which illustrate one or more embodiments of the device(s), method(s) and system(s) of the present disclosure, although it will be understood that such drawings depict preferred embodiments of the present disclosure and, therefore, are not to be considered as limiting its scope with regard to other embodiments which may be contemplated from the present disclosure. Accordingly:

FIG. 2A shows a top view illustrating a preferred embodiment of the device with interchangeable Smart Cartridges according to the various embodiments described herein.

FIG. 2B shows a front view illustrating a preferred embodiment of the device with interchangeable Smart Cartridges according to the various embodiments described herein.

FIG. 2C shows a side view illustrating a preferred embodiment of the device with interchangeable Smart Cartridges according to the various embodiments described herein.

It is to be understood that the teachings herein can be modified for other presently known or future configurations according to the various embodiments described herein.

DETAILED DESCRIPTION

The following description refers to numerous specific details which are set forth by way of examples to provide a thorough understanding of the relevant device(s), method(s) and system(s) disclosed herein. It should be apparent to those skilled in the art that the present disclosure may be practiced without such details. In other instances, well known methods, procedures, components, instruments, implements and/or devices have been described at a relatively high level, without detail, in order to avoid unnecessarily obscuring aspects of the present disclosure.

In describing the present disclosure, it will be understood that a number of techniques and steps are disclosed. Each has individual benefits, and each can also be used in conjunction with one or more (or in some cases all) of the other disclosed techniques. Accordingly, for the sake of clarity, this description will refrain from repeating every possible combination of the individual steps in an unnecessary fashion; nevertheless, the specification and any claims should be read with the understanding that such combinations are entirely within the scope of the present disclosure in any claims.

In the following description, for the purpose of explanation, numerous specific details are set forth in order to provide a thorough understanding of the present disclosure. It will be evident, however, to one skilled in the art that the present disclosure maybe practiced without the specific details.

The present disclosure is to be considered as an exemplification of the present disclosure and is not intended to limit the present disclosure to specific environments illustrated by the figures for description below.

The present disclosure will now be described by referencing the appended figures representing preferred environments.

Figure 1:
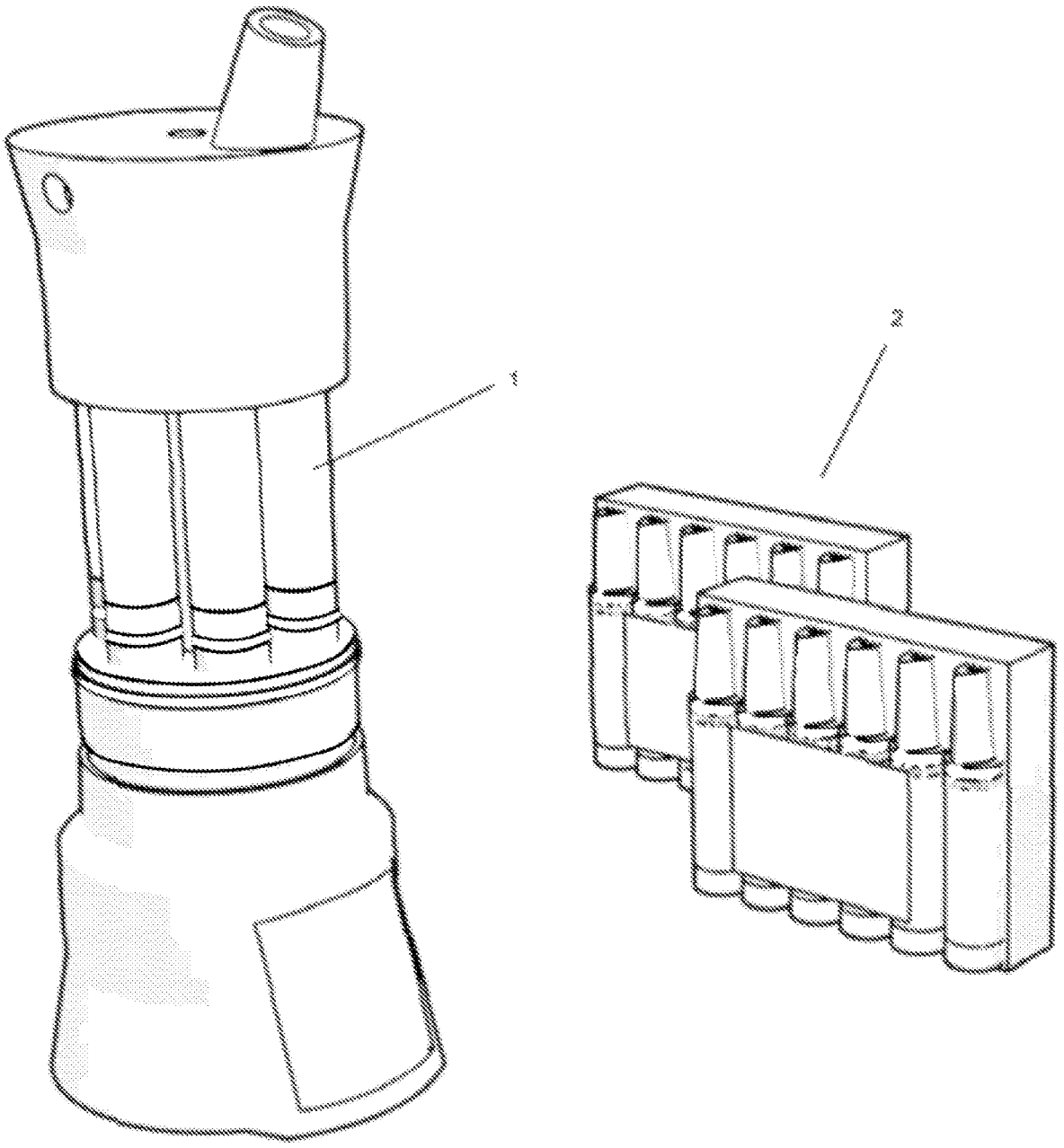
FIG. 1 shows a perspective view illustrating a preferred embodiment of the preferred device, showing a stand-alone main base unit loaded with six cannabinoid oil cartridges along with extra interchangeable Smart Cartridges.

FIG. 1 shows a perspective view illustrating a preferred embodiment of the preferred device, showing a stand-alone main base unit loaded with six cannabinoid oil cartridges (1) along with extra interchangeable Smart Cartridges (2).

FIG. 2A shows a top view illustrating a preferred embodiment of the real-time, six-cartridge cannabinoid blend and vape device without mouthpiece casing (4) (shown, e.g., in FIG. 2B), showing the positioning of the six Smart Cartridges mouthpieces or outlets (3).

FIG. 2B shows a front view illustrating a preferred embodiment of the real-time, six-cartridge cannabinoid blend and vape device, showing a stand-alone main base unit loaded with six Smart Cartridges (1). The front view of the preferred embodiment also shows the mouthpiece casing (4) fitting over the six cartridge mouthpieces (3) (shown in FIG. 1). It also shows the base (6) and battery cavity (7) where two or four 3.7 v-5 v rechargeable lithium power cells are mounted to give power to the unit, to add weight to the bottom base (6) for balance and to be in close proximity to the control panel (25) (shown in FIG. 6) that fits in the opening and covers the battery cavity (7). The base is fitted into the connector module (5) and is where the cartridges (1) are screwed into the unit. The preferred embodiment of the main housing for the real-time, six-cartridge cannabinoid blend and vape device (4, 5, 6) is designed to be made out of quality plastic and injection molded for easy cleaning and maximum durability. The unit's preferred measurements will be 2" diameter×9" high but may vary with features and any new requirements.

FIG. 2C shows a side view illustrating a preferred embodiment of the real-time, six-cartridge cannabinoid blend and vape device, showing a stand-alone main base unit loaded with six Smart Cartridges (1). The side view of the preferred embodiment also shows the mouthpiece casing (4) fitting over the six cartridge mouthpieces (3) (shown in FIG. 1). It also shows the base (6) and battery cavity (7) where two to four 3.7 v-5 v lithium power cells (44) are mounted to give the unit power to the unit, to add weight to the bottom (6) for balance, and to be in close proximity to the control panel (25) (shown in FIG. 6) that fits in the opening and covers the battery cavity (7). The base is fitted onto the connector module (5) and is where the cartridges (1) are screwed into the unit. The side view in a preferred embodiment also shows the mouthpiece casing (4) and its air vents (8) for vapor flushing.

Figure 3:
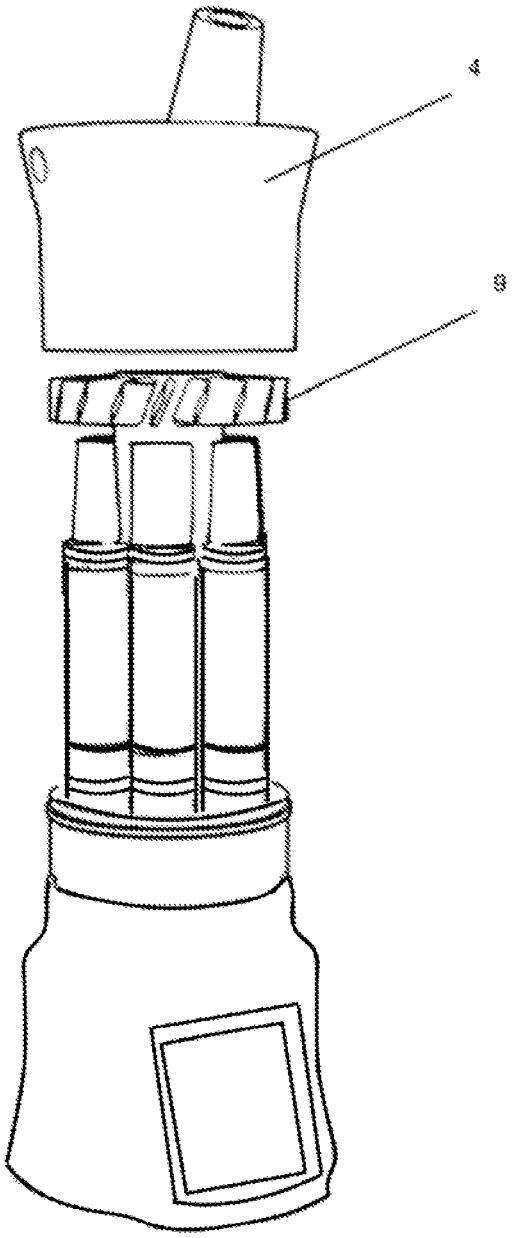
FIG. 3 shows a perspective view exploded, illustrating a preferred embodiment of the device with interchangeable Smart Cartridges loaded according to the various embodiments described herein.

FIG. 3 is an exploded perspective view diagram showing a preferred embodiment of the device(s), method(s) and system(s) of this present disclosure, depicting the internal air driven circulation fan (9) that is responsible for distributing the vapor of the six cartridge outputs equally to the user when vaping and air is being pulled from the mouthpiece casing (4). When the user draws on the mouthpiece casing (4) to get vapor, the air current circulates the fan (9), thus distributing the vapor in the top portion of the mouthpiece casing (4) and giving a well-blended combination of each one of the six cartridges (1) selected. The fan blades mount on a center spindle (10) (shown in FIG. 413) and spin closely above, preferably 0.15 inches above, the cartridge mouthpieces (3).

Figure 4A:
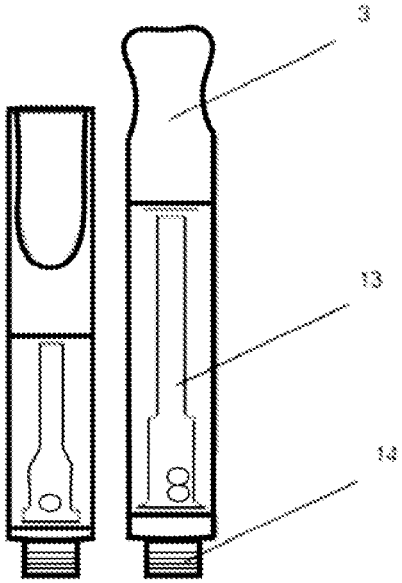
FIG. 4A shows a view illustrating a preferred embodiment of typical cartridge structures according to the various embodiments described herein.

FIG. 4A is an exploded perspective view diagram showing a preferred embodiment of the device(s), method(s) and system(s) of this present disclosure. Depicted are the inner workings of a typical commercial cartridge, showing the mouthpiece (3), the heating element (13) used to heat the oil and create vapor, and the male 510 connector (14), which is screwed into a corresponding female 510 connector (12) on the connector module (5) (see FIG. 4B), connecting the heating element to power.

Figure 4B:
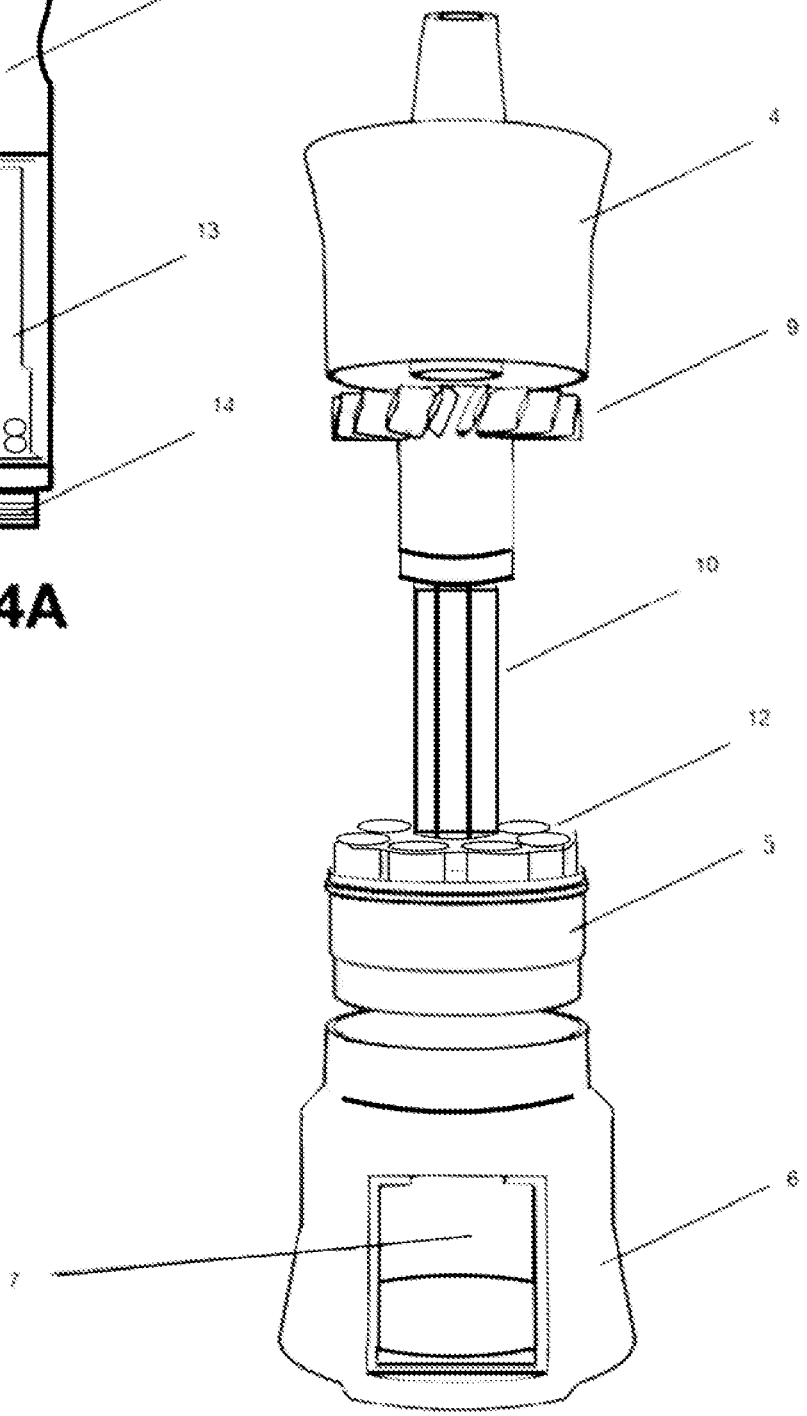
FIG. 4B shows a perspective view exploded, illustrating a preferred embodiment of the device without interchangeable Smart Cartridges according to the various embodiments described herein.

FIG. 4B is an exploded perspective view diagram showing a preferred embodiment of the device(s), method(s) and system(s) of this present disclosure depicting the real-time, six-cartridge cannabinoid blend and vape device without cartridges. The mouthpiece casing (4) fits over the internal air driven circulation fan (9) and also over the cartridge mouthpieces (3) when loaded, creating an air suction hood to collect vapor from cartridges (1). The internal air-driven circulation fan (9) rotates on the fan spindle (10), which is mounted on the 510 connector module (5) and comes in 2 sizes: one for half gram cartridges and one for full gram cartridges (1), which are a half inch longer then half gram cartridges (1). The view in a preferred embodiment also shows the six female 510 connectors (12) mounted to the 510 connector module (5). All wiring for the 510 connectors (12) runs to the base (6), where connections to the control panel (25) and battery are made. The female 510 connectors (12) feed voltage, ranging from zero to five volts, to the cartridge heating elements when loaded. Each connector is separately controlled and has individual heat settings that are used to control the amount or intensity of the vapor produced per cartridge. The combinations of the six cartridges all heated to individual heat settings allow the device to create hundreds of combinations of vapor.

Figure 5:
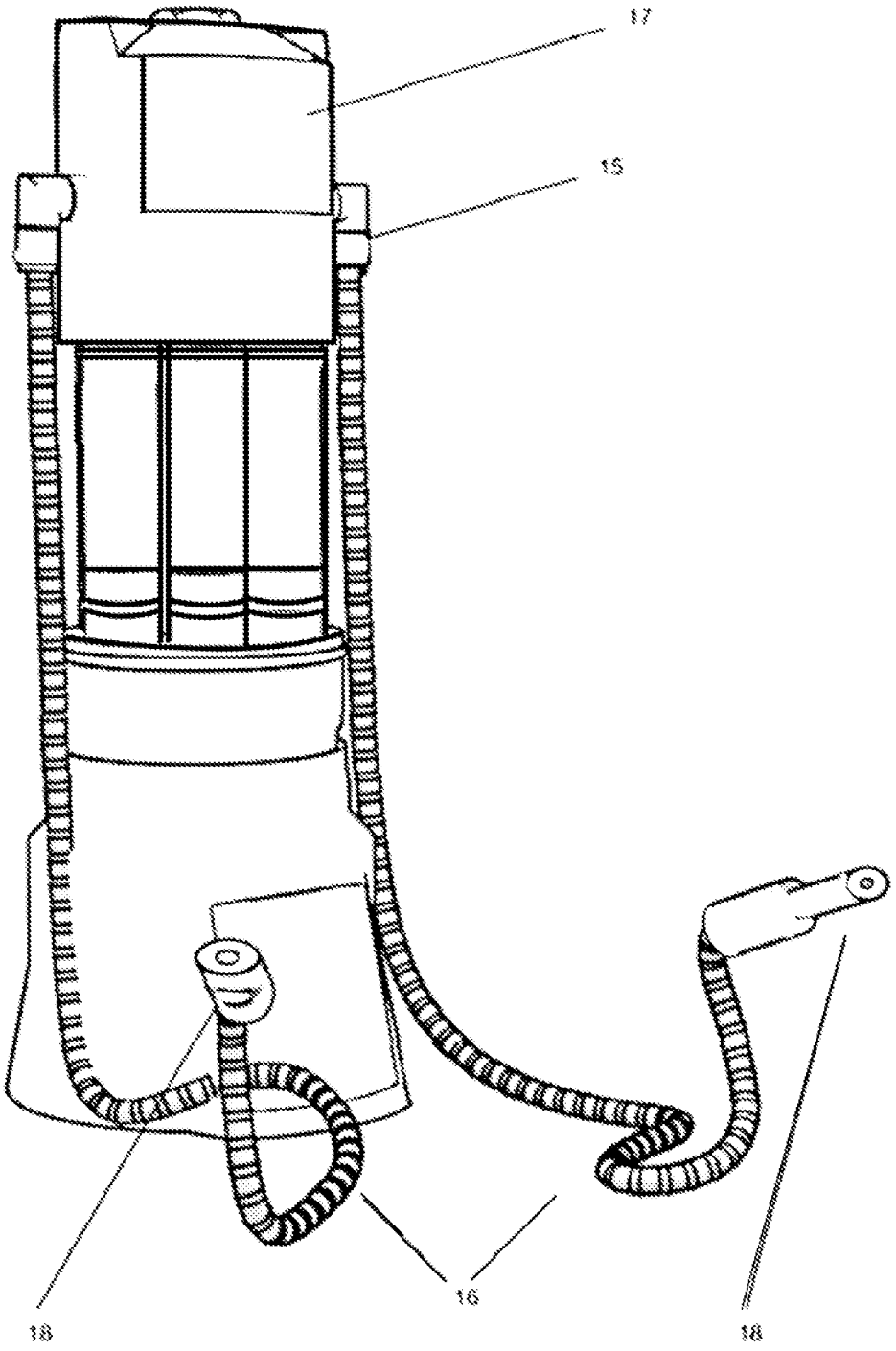
FIG. 5 shows a perspective view illustrating a preferred embodiment of the device with interchangeable water vortex mouthpieces with two hoses according to the various embodiments described herein.

FIG. 5 is a perspective view diagram showing an alternate embodiment of the device(s), method(s) and system(s) of this present disclosure depicting the real-time, six-cartridge cannabinoid blend and vape device with a water vortex mouthpiece casing (15) and hoses (16) with plastic replaceable tips (18). The water vortex collects the vapor from the device and bubbles it through a water reservoir (17), creating a water pipe sensation and offering a smooth, shareable vapor experience. Both hoses allow sharing and replaceable hose tips (18).

Figure 6:
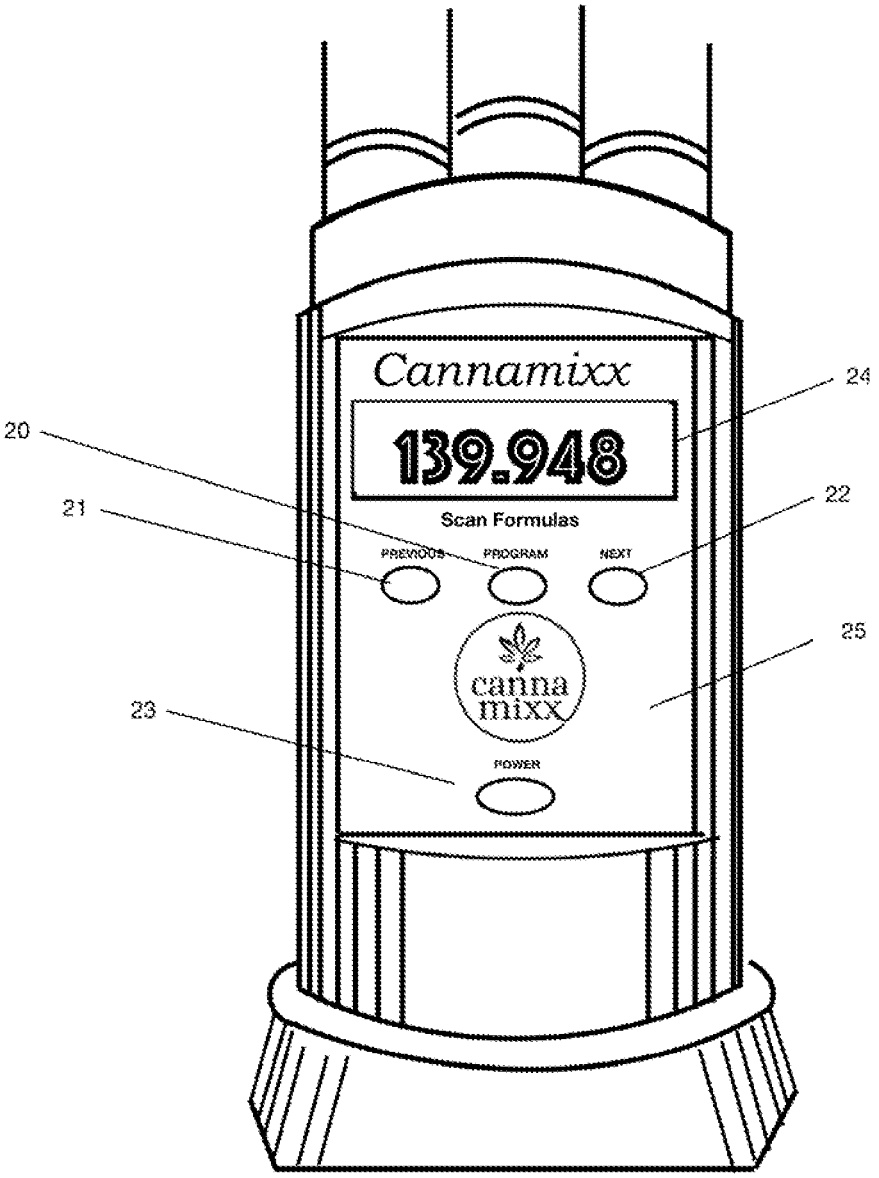
FIG. 6 is a diagram illustrating a preferred embodiment of the control panel housing and the buttons used to program and activate the vaping process.

FIG. 6 is a front view diagram showing a preferred embodiment of the device(s), method(s) and system(s) of this present disclosure depicting the real-time, six-cartridge cannabinoid blend and vape device control panel (25) and its navigation buttons (21, 22), program selector button (20), power readout (24), and activation button (23). The program button (20) selects which cartridge to adjust, and the navigation buttons (21, 22) raise and lower the desired heat setting for that cartridge (I). The activation button (23) will connect power to the device and allow the cartridges (1) to heat up to their preset settings.

The QR Code on each cartridge gets scanned by the external controlling computer, phone or tablet into the mixing software, and then that information gets transferred to the device via Bluetooth or Wifi or a suitable cable such as a USB cable. In an alternate embodiment, the device may have suitable hardware internally and the mixing software may reside directly on the device. A scanner associated with the device control panel (25) can scan the QR code directly into the device.

Figure 7:
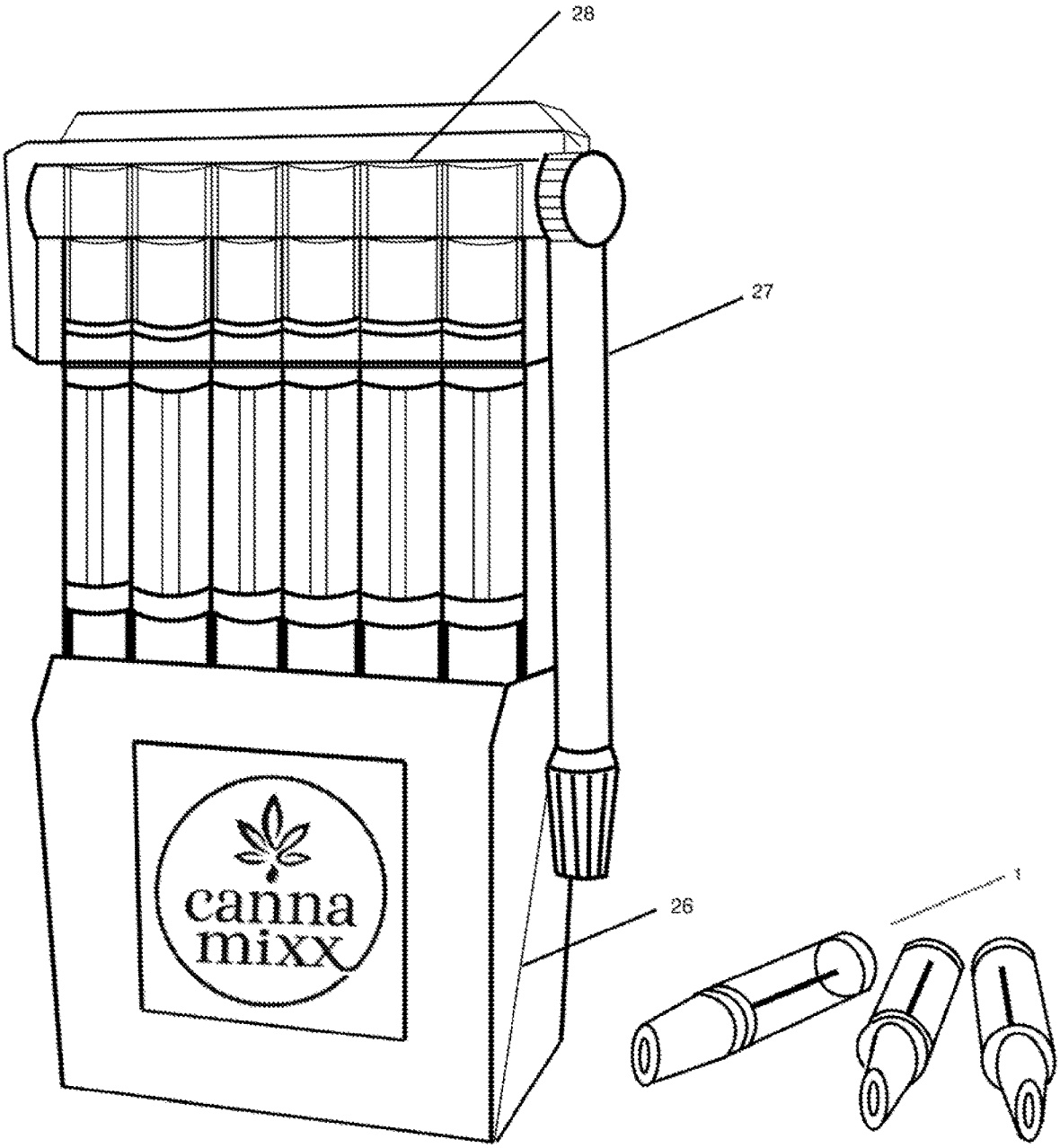
FIG. 7 shows a front perspective view illustrating an alternate embodiment of the pocket-size, real-time, six-cartridge cannabinoid blend and vape device according to the various embodiments described herein.

FIG. 7 shows a front perspective view illustrating an alternate embodiment of the real-time, six-cartridge cannabinoid blend and vape device in a rectangular shaped body (26) to fit in a user's pocket and uses the same heating and programing logic. It also illustrates an adjustable mouthpiece (27) and a vapor cavity (28) to accumulate vapor during the heating process. Batteries and circuits are located in the rectangular-shaped body (26) according to the various embodiments described herein.

Figure 8:
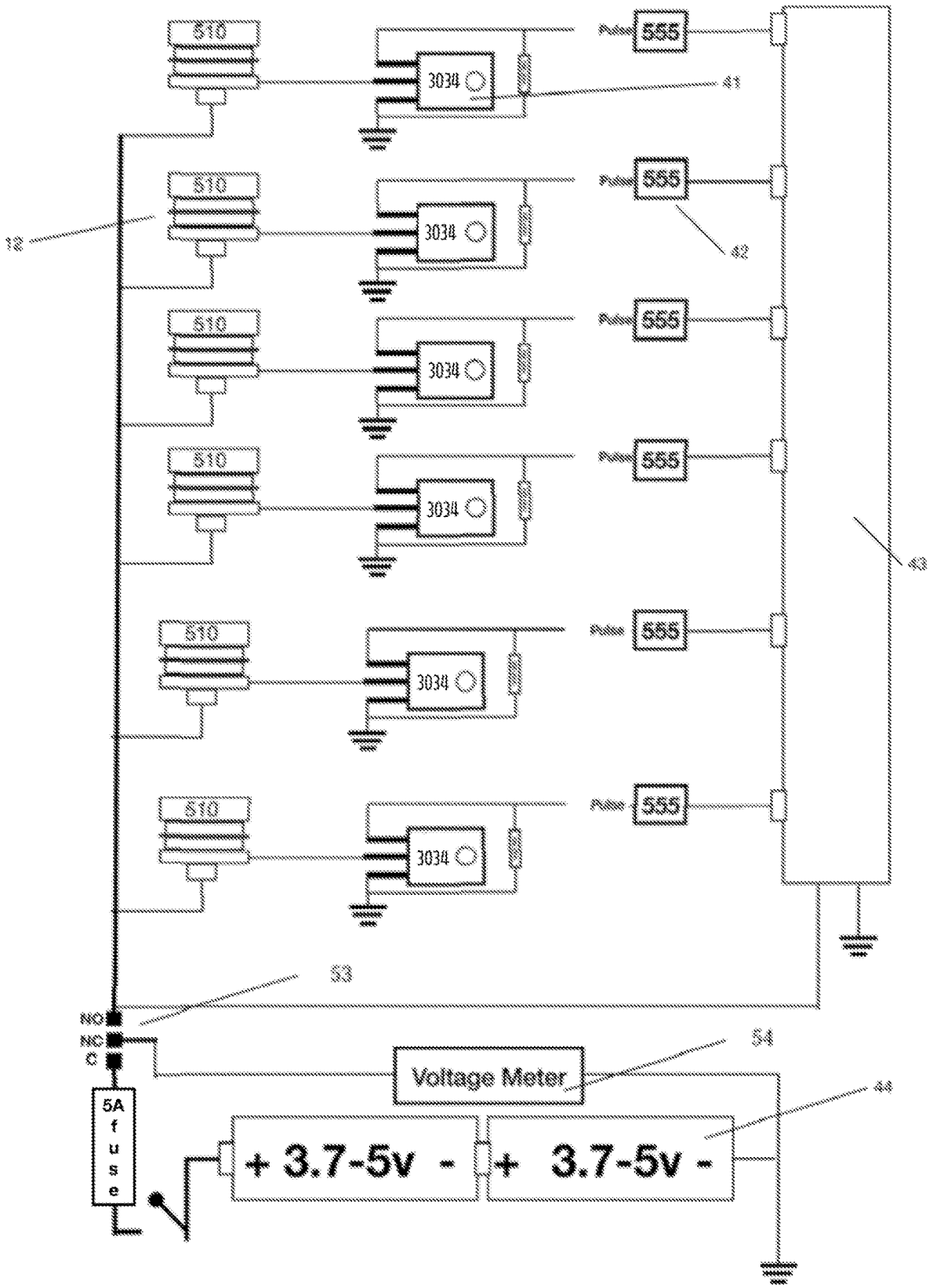
FIG. 8 is a diagram illustrating the wiring and component connections of a preferred embodiment of the present disclosure.

FIG. 8 is a diagram showing a preferred embodiment of the device(s), method(s) and system(s) of this present disclosure depicting the real-time, six-cartridge cannabinoid blend and vape device wiring schematic, showing six 510 connectors (12) with their positive voltage source coming from a respective 3034 40V single N channel HEXFET power MOSFET in TO-220AB package (41). The 3034 unit is pulsed at various frequencies to regulate the amount of voltage the 510 connector (12) is allowed to consume and is controlled by a respective 555 timer chip (42). The timer chip presets are controlled by a multi-processor (43). A momentary switch (53) switches the battery power source (44) from a volt meter (54) to the active state of heating the 510 cartridge heating elements (13) when loaded.

By individually controlling the voltage through pulsed or regulated power to each 510 cartridge connector to control the amount of vapor produced through different heat settings, users can blend their perfect vape combination. Vapor blends can be stored on the proprietary mixing software and can be downloaded to the device, preferably via Bluetooth. By enabling users the ability to select and load the unit with their favorite cartridges (THC, CBD, CBG, CBN terpenes, etc.), the device offers infinite combinations. This empowers users with a variety of combinations to accommodate the wide range of vapor formulas needed to satisfy the next stage of this industry: personalized *cannabis* solutions.

Accordingly, the above described device(s), system(s) and method(s) of the present disclosure have numerous features, including for example without limitation, a real-time, six cartridge cannabinoid blend and vape device; controllable either manually or through personal computer cannabinoid mixing software; two-stage mixing process allowing a user to create hundreds of cannabinoid combinations from a single device; interchangeable Smart Cartridges; cannabinoid Smart Cartridge technology information used in a cannabinoid blend and vape device; cannabinoid blend and vape device having a pocket-sized, rectangular-shaped body; and use of an internal air-driven circulation fan that is responsible for distributing the vapor of the six outputs equally to the user when vaping.

It is to be understood that the teachings herein can be modified for other presently known or future configurations according to the various embodiments described herein or which may be contemplated.

While the present disclosure has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the device(s), method(s) and system(s) illustrated herein and of their operation can be made by those skilled in the art without departing from the spirit of this present disclosure.

What is claimed is:

1. A device for cannabinoid blending and vaping comprising:

a base having a plurality of 510-type female cannabinoid cartridge connectors;

a plurality of cannabinoid cartridges each having a 510-type male cannabinoid connector and an outlet; and a removable mouthpiece casing positioned over the plurality of cannabinoid cartridges, the mouthpiece casing having a plurality of holes for receiving the outlet of each of the plurality of cannabinoid cartridges, wherein the mouthpiece casing comprises a water vortex mouthpiece casing having a water reservoir.

2. The device of claim 1, further comprising an air driven circulation fan in the mouthpiece casing.

3. The device of claim 1, wherein each of the a plurality of cannabinoid cartridges is independently interchangeable with one of a plurality of off-the-shelf cannabinoid cartridges having various sizes and 510-type male cannabinoid connectors.

4. The device of claim 1, wherein the water vortex mouthpiece casing has multiple hose attachments connecting multiple hoses with replaceable tips.

5. The device of claim 1, wherein the device has a cylindrical shape.

6. The device of claim 1, wherein the device has a rectangular shape, and a retractable intake straw in the mouthpiece casing.

7. A device for cannabinoid blending and vaping comprising:

a base unit having a plurality of 510-type female connectors;

a plurality of cannabinoid oil vape pen cartridges removably connected in the base unit, wherein each of the plurality of cannabinoid oil vape pen cartridges has an outlet and a 510-type male connector;

a removable mouthpiece casing positioned above the plurality of cannabinoid oil cartridges, the mouthpiece casing having a plurality of holes for receiving the outlet of each of the plurality of cannabinoid cartridge, wherein the mouthpiece casing comprises a water vortex mouthpiece casing having a water reservoir; and an air driven circulation fan in the mouthpiece casing.

8. The device of claim 7, wherein the base unit comprises a base and a connector module.

9. The device of claim 8, wherein the base is fitted into the connector module to form the base unit, and the plurality of cannabinoid oil vape pen cartridges are removably attached into the base unit via corresponding 510-type male and 510-type female connectors.

10. The device of claim 7, wherein the base unit has a battery cavity for receiving batteries.

11. The device of claim 7, wherein the mouthpiece casing includes at least one air vent for vapor flushing.

12. The device of claim 7, wherein the air driven circulation fan is mounted on a center spindle.

13. The device of claim 7, wherein the plurality of cannabinoid oil cartridges each have a heating element for heating cannabinoid oil and creating a vapor, and wherein the base unit has no heating element.

14. The device of claim 13, wherein each 510-type female connector is adapted to feed voltage to the heating element, wherein the voltage is pulsed at various frequencies to independently regulate the amount of voltage supplied to each 510-type female connector.

15. The device of claim 14, wherein the base unit includes a control panel.

16. The device of claim 15, wherein each 510-type female connector is separately controlled by the control panel and has individual heat settings for controlling the amount or intensity of the vapor produced in each cartridge.

17. The device of claim 15, wherein the control panel includes manually operated navigation buttons.

18. The device of claim 15, wherein the control panel has an interface for receiving formula mixing instructions.

19. The device of claim 18, wherein each of the plurality of cannabinoid oil cartridges include a QR Code that has specific information about its contents.

20. The device of claim 19, wherein the control panel includes a processor configured to run mixing software to allow a user to create, save and use a cannabinoid formula as a preset output blend of custom vapors.

21. The device of claim 20, wherein the interface inputs the specific information from the QR Code to the processor.

* * * * *